United States Patent [19]

Igeta

[11] 4,164,625

[45] Aug. 14, 1979

[54] A/C CIRCUIT FOR COMBINING AN AUTOMOBILE RADIO SPEAKER WITH SPEAKERS OF AN AUTOMOBILE STEREOPHONIC SYSTEM

[76] Inventor: Harutoshi Igeta, No. 17-24, 3-chome, Kirennishi, Hirano-ku, Osaka-shi, Osaka-fu, Japan

[21] Appl. No.: 867,379

[22] Filed: Jan. 6, 1978

[30] Foreign Application Priority Data

Feb. 7, 1977 [JP] Japan ..... 52-13970

[51] Int. Cl.[2] ..... H04R 5/04

[52] U.S. Cl. ..... 179/1 SW; 179/1 G

[58] Field of Search ..... 179/1 SW, 1 VE

[56] References Cited

U.S. PATENT DOCUMENTS

| | | | |
|---|---|---|---|
| 2,335,575 | 11/1943 | Bierwirth | 179/1 G |
| 3,397,286 | 8/1968 | Prewitt et al. | 179/1 G |

*Primary Examiner*—William C. Cooper

*Attorney, Agent, or Firm*—George B. Oujevolk

[57] ABSTRACT

A circuit arrangement for combining a car radio speaker into the circuit of a car stereo system having left and right speakers; to accomplish this changeover switches, control devices for sound volume, variable resistance apparatus, damping circuits on the left and right sides, amplifiers, and illuminating members are additionally provided for carrying out the changeover between speakers as well as to control the sound quality and volume.

1 Claim, 11 Drawing Figures

A/C CIRCUIT FOR COMBINING AN AUTOMOBILE RADIO SPEAKER WITH SPEAKERS OF AN AUTOMOBILE STEREOPHONIC SYSTEM

This invention relates to a device for obtaining an added use of an automobile radio speaker by combining it with an automobile stereo system having left and right speakers.

At present, speakers for the car stereo are usually rearpositioned 2-speaker system in which two sets of speakers are generally mounted on the parcel tray in the rear of seat in the car, one on the left side and the other on the right. However, almost all cars are equipped with one set of front speaker, for example, the speaker for the monaural car radio, prior to delivery. Thus, in general, three sets of speakers are provided, two used solely for the car stereo in the rear and one for the car radio in front, when the 2-channel car stereo is mounted on the car. However, in practice, two sets of speakers in the rear are used only for car stereo and one in front only for radio, one being operated independently of the other causing a loss. On the other hand, the car body is so small that there is a strong desire for hearing sound which seems to fill the car while hearing the sound. To meet this objective, a 4-channel-4-speaker stereophone system has been manufactured but it is very costly.

The detail of this invention will be described referring to the appended drawings. Other features and advantages of this invention will be more apparent therefrom.

Figure 1:
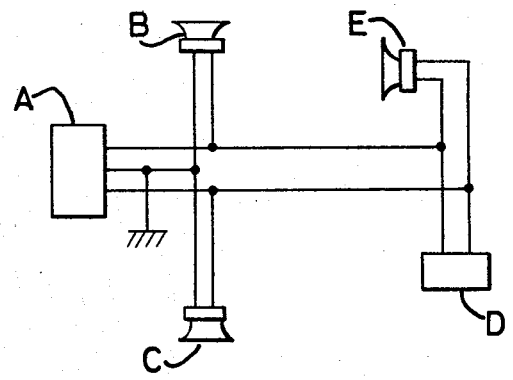
FIG. 1 is a diagram showing a fundamental circuit composition in this invention.
Figure 2:
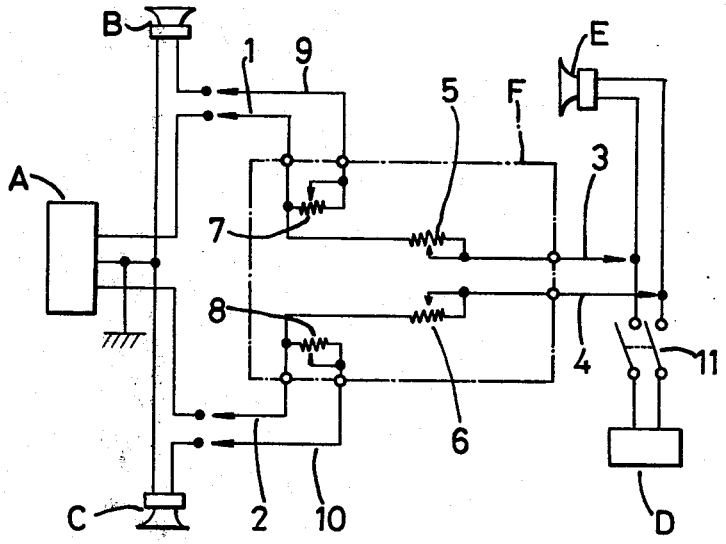
FIG. 2 is a diagram of circuit showing the 1st embodiment of this invention.
Figure 3:
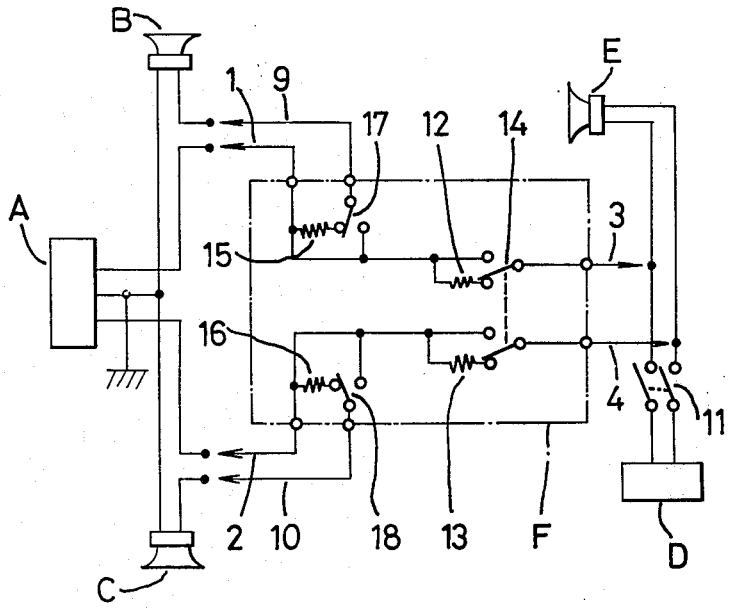
FIG. 3 is a diagram of circuit showing the 2nd embodiment of this invention.

Now referring to FIG. 1 showing a fundamental circuit in this invention, the output circuits on the left and right sides B and C of the car stereo amplifier A are connected to both terminals of the speaker E of the other sound instrument such as the car radio D provided in front of the seat. Referring to FIG. 2 showing the 1st embodiment of this invention, the left side output connecting cord 1 to be connected to the output terminal for the left side speaker of the car stereo amplifier A and the right side output connecting cord 2 to be connected to the output terminal for the right side speaker are connected with the connecting cords 3 and 4 of the radio speaker to be connected to both terminals of the car radio speaker E through the left and right side variable resistors 5 and 6. The left and right side output connecting cords 1 and 2 are also connected with the left and right side speaker connecting cords 9 and 10 which are connected to terminals of the left and right side speakers B and C through the variable resistors 7 and 8. In addition, between the left and right side output connecting cords 1 and 2 and the variable resistors 5 and 6 provided is the two-pole switch 11, which is capable of turning on or off two lines at the same time, to turn the radio speaker E on and off. Incidentally, when variable resistors 5 and 6, or, 7 and 8 are made of the two-pole type, they can be used more conveniently as their performance will be varied at the same time on both sides. FIG. 3 shows the 2nd embodiment of this invention in a housing F wherein the resistance value is varied by means of changeover switch, using the stationary resistors instead of the variable resistors used in the 1st embodiment. That is, the left and right side output connecting cords 1 and 2 of the car stereo amplifier A are connected with the radio speaker connecting cords 3 and 4 respectively through the stationary resistors 12 and 13 having the same resistance value on both sides as well as through the changeover two-pole switch 14 both poles of which operate in association with each other. The left and right side output connecting cords 1 and 2 are connected with the left and right side speaker connecting cords 9 and 10 through the stationary resistors 15 and 16 having the same resistance value on both sides as well as through the changeover switches 17 and 18. When the number of stationary resistors 12 and 13, or, 15 and 16 is increased according to the number of contacts of the two-pole changeover switch 14 or the changeover switches 17 and 18, finer adjustment of sound volume is obtained. Sound volume in the front speaker E can be controlled with the variable resistors 5 and 6, or the two-pole changeover switch 14. Sound volume in the left and right side speakers B and C can be controlled with the variable resistors 7 and 8 or the changeover switches 17 and 18. The two-pole switch 11 turns the front speaker E on or off at the time of sound reproduction in the car stereo system.

As the left and right side output poles of stereo amplifier A are connected to both terminals of the radio speaker E, the speaker E operates to emit sound corresponding to a difference in volume between the left and right side stereo speakers, serving as the simplest speaker matrix 3-channel system and creating a sensation of sound in-front against the rear speakers B and C on both sides, which leads to the intensified sound sensation in a small vehicle.

As is apparent from the above description, this invention makes it possible to convert sound through the conventional 2-channel-2-speaker stereo system into a 3-speaker system so as to produce full stereophonic sound.

Figure 4:
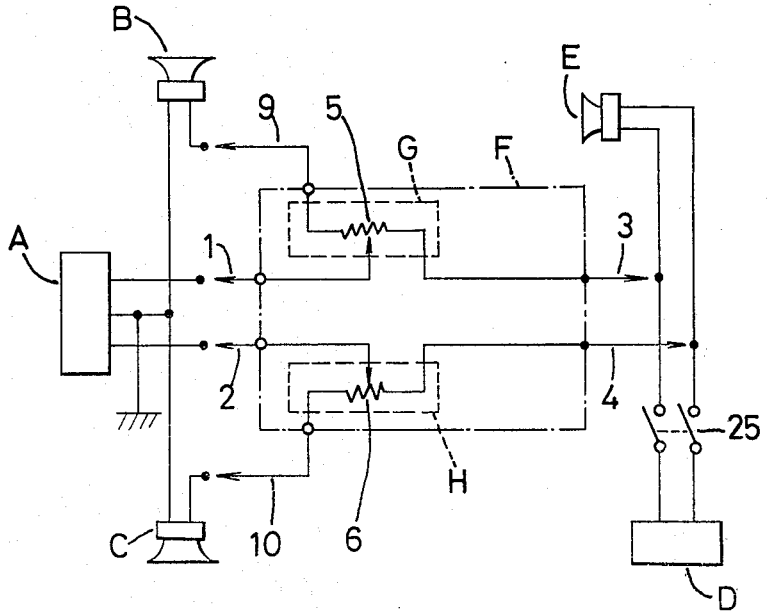
FIG. 4 is a diagram of circuit showing the 3rd embodiment of this invention.

Referring to FIG. 4, the 3rd embodiment of this invention will be described as hereunder:

Although an arrangement for converting a 2-speaker system into a 3-speaker system has been described hereinbefore, volume control is difficult and a better arrangement is needed for balancing the sound volume between the front and rear speakers.

The variable resistors 5 and 6, as resistance apparatus G and H whose resistance value is variable, are interposed between and connected to both side speaker cords 9 and 10 to be connected to the terminals of both side stereo speakers B and C and the speaker connecting cords 3 and 4 for radio to be connected to both terminals of radio speaker E, and, both side amplifier output connecting cords 1 and 2 to be connected to both side output terminals of the stereo amplifier A are connected to the middle terminal of the variable resistors 5 and 6.

Figure 5:
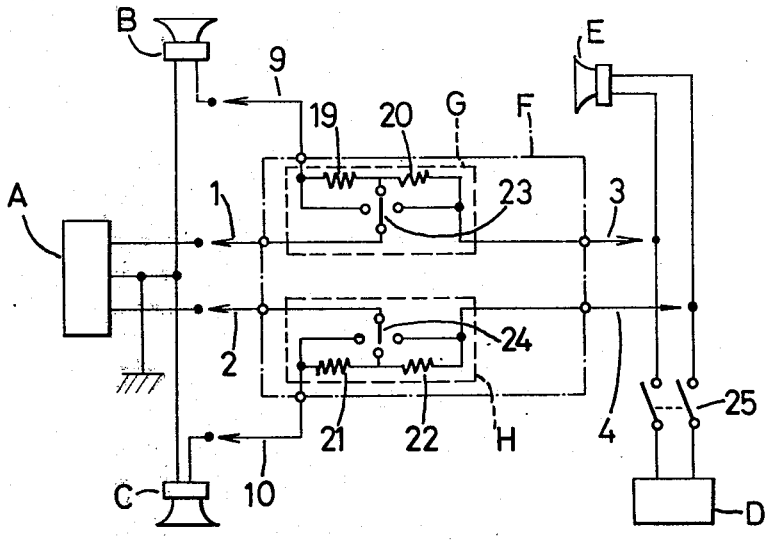
FIG. 5 is a diagram of circuit showing the 4th embodiment of this invention.

Referring to FIG. 5 showing the 4th embodiment of this invention, a plurality of stationary resistors 19 and 20, and, 21 and 22, as resistance apparatus G and H whose resistance value is variable, are interposed between and controlled to both side speaker connecting cords 9 and 10 and the radio speaker connecting cords 3 and 4, and the resistance value in each of resistors is adapted to be capable of being varied by providing taps to be connected to the middle point between two resistors as well as to one end of each resistor and performing changeover between the taps and the change-over switches 23 and 24, to base points of which both side amplifier output connecting cords 1 and 2 are connected. Finer adjustment of resistance value is made possible by increasing the number of said stationary resistors.

In the 3rd and 4th embodiments, greater convenience can be obtained by selectively using the two-pole type of both side variable resistors 5 and 6 and change-over switches 23 and 24 which are capable of changing performance thereof on both sides simultaneously.

The two-pole on-off switch 25 is provided between the resistance apparatus G and H and the connecting cords 3 and 4 of the radio speaker, which can turn off the output circuit of the car stereo and of the speaker.

Referring to FIGS. 3 and 4 in which embodiments of this invention are composed as stated above, function thereof will be described as hereunder:

The output on both sides of the amplifier A is divided into that for the front seat side and for the rear one by the variable resistors 5 and 6 or the stationary ones 19 and 20, and, 21 and 22, and transmitted to terminals of the front radio speaker E and both side stereo speakers B and C. Therefore, turning of the knob of the variable resistors 5 and 6 or the changeover switches 23 and 24 permits proper adjustment for balancing sound volume between the front speaker and the rear ones, rendering the resistance value thereof to be varied.

Figure 6:
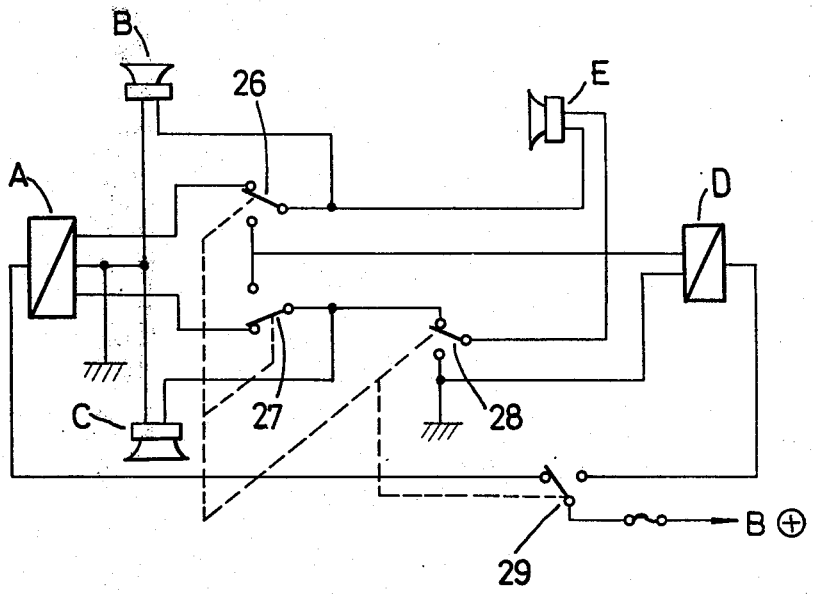
FIG. 6 is a diagram of circuit showing the 5th embodiment of this invention.

Referring to FIG. 6 showing the 5th embodiment of this invention, one simple operation of switching provides the changeover between the car stereo system and the car radio, and the sound in the car radio can be reproduced in a way of 3-speaker system.

FIG. 6 is an illustration showing a fundamental circuit composition in which the changeover switch 29 switches (+) power source of the battery B to that for the stereo amplifier A or for the radio amplifier D. The (+) terminal of the left side speaker B and that of the right side one C are connected to the terminals of radio speaker E, and the changeover switches 26 and 27 are adapted to switch said speaker (+) circuit to the stereo amplifier output poles on both sides or to (+) output poles of radio amplifier D. The changeover switch 28 is adapted to switch the (−) terminal pole of the front speaker in front of the seat, e.g., radio speaker, to the right side output (+) circuit or to the output (−) pole of the radio amplifier D. The changeover switches 26, 27, and 28 are all adapted to operate in association with the changeover switch 29.

Figure 7:
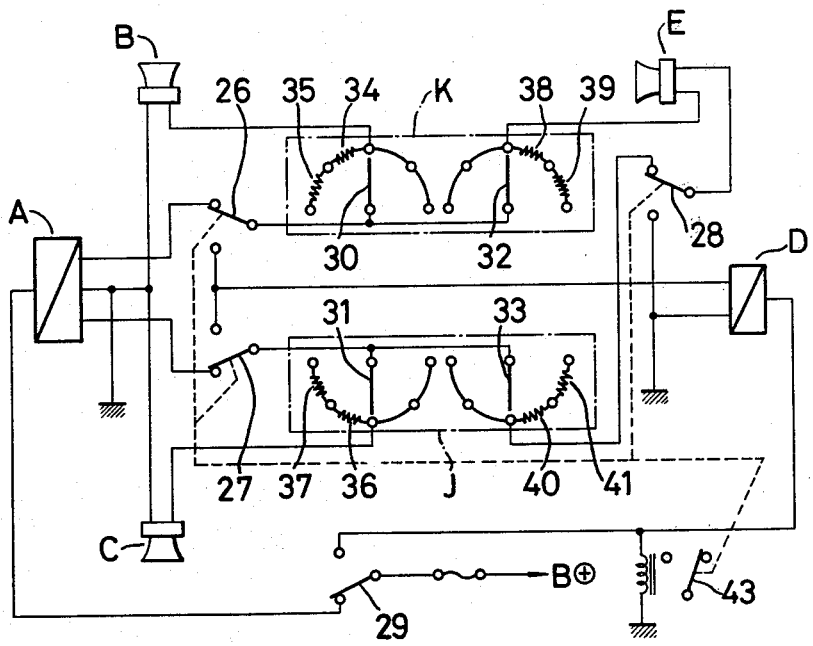
FIG. 7 is a diagram of circuit showing the 6th embodiment of this invention.

Referring to FIG. 7 which is an illustration of circuit composition showing the 6th embodiment, both side output damping circuits J and K comprising resistors are put into both side speaker circuits appearing in FIG. 6. In other words, the rotary switches 30, 31, 32, and 33 operating in association with each other are provided to serve as both side output damping circuits J and K of the stereo amplifier; both output (+) poles of the stereo or of the radio are adapted to be connected to their corresponding movable contact; and (+) terminals of both side speakers B and C as well as of the radio speaker E are connected to the middle contact of the rotary switches 30 and 31 as well as of 32. The (−) terminal of the radio speaker E is adapted to be switched to the middle contact of the rotary switch 33 or to (−) output pole of the radio amplifier D. The stationary resistors 34, 35, 36, and 37 are connected to the left side contacts including the middle one, while the right side contacts are connected with each other provided with no resistor therebetween. Opposite to the aforesaid arrangement, the left side contacts 32 and 33 are connected with each other having no resistor therebetween and the right side ones including the middle one are provided with the stationary resistors 38, 39, 40, and 41.

The pole on the side of coil of electromagnetic relay 43 having a 3-contact circuit is connected to the power source circuit of radio amplifier D which is to be connected to the changeover switch 29, and said 3-contact circuit is utilized as the changeover switches 26, 27, and 28.

Figure 8:
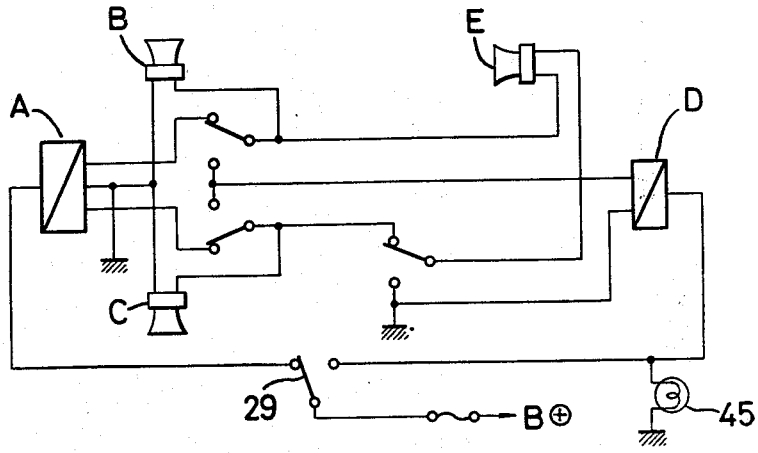
FIG. 8 is a diagram of circuit showing the main portion of the 7th embodiment of this invention.

FIG. 8 shows the main portion of the 7th embodiment of this invention. In the 5th embodiment, the position of operating contact must be ascertained by the user at all times as the power source of either stereo amplifier A or the radio amplifier D is turned off according to the position of operating contact. Therefore, a pilot lamp is provided in the power source circuit in order to ascertain without difficulty whether the position of operating contact of the changeover switch 29 lines on the side of stereo or on that of radio.

Figure 9:
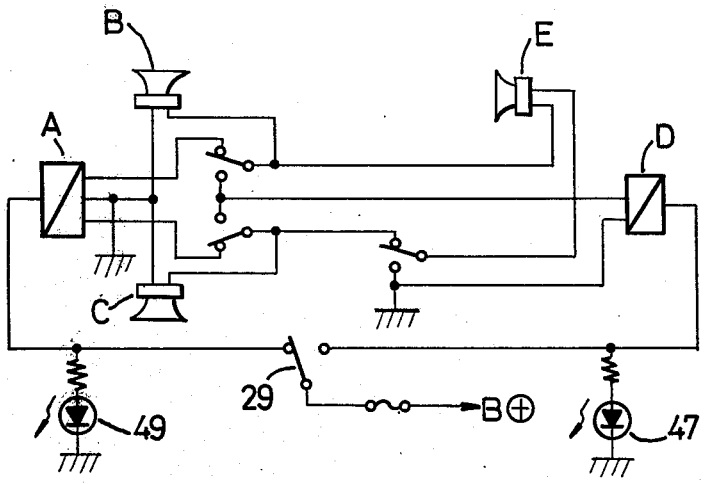
FIG. 9 is a diagram of circuit showing the 8th embodiment of this invention.

In FIG. 8, an electric bulb 45 as pilot lamp is provided in the power source circuit for the radio, and FIG. 9 shows the 8th embodiment in which illuminating diodes 47 and 49 are used in the power circuit for both the radio and the stereophone.

In FIG. 7, when the changeover switch 29 is put into the position as shown in the drawing, i.e., the (+) power source of the battery B is connected with the power source side of the stereo amplifier A, the electromagnetic relay 43 is not actuated and accordingly the contacts of the changeover switches 26, 27, and 28 are all in connection with their corresponding contact as shown in the diagram. Provided that the knobs of rotary switches are all put in the middle position, i.e., the movable contacts are all put in the position of middle contact as shown in the diagram, the output (+) poles of the stereo amplifier A are directly connected to the (+) terminals of both side speakers B and C and both terminals of radio speaker E, and three sets of speakers are operated by a maximum output. When the knobs of rotary switches are turned leftward, the rotary switches 30 and 31 supply both side speakers B and C with stereo output through both side stationary resistors 34 and 35, or, 36 and 37. The more the knobs are turned leftward, the more the sound volume in both side speakers B and C is decreased. On the other hand, the radio speaker E is operated without decrease of output since the left side contacts of the rotary switches 32 and 33 are connected with each other having no resistance therebetween.

When the knobs of rotary switches are turned rightward, the rotary switches 30 and 31, contrary to the foregoing, supply both side speakers B and C with a stereo output since there is no resistor, and the rotary switches 32 and 33 supply both terminals of the radio speaker E with a stereo output through the stationary resistors 38, 39, 40, and 41, decreasing sound volume of only the radio speaker.

When the changeover switch 29 is put in the opposite position, i.e., the (+) power source of the battery B is connected to the power source side of the radio amplifier D, the power source for the stereo amplifier A is turned OFF and the coil of the electromagnetic relay 43 connected to the power source circuit of the radio amplifier is actuated by electric current flowing thereinto and the 3-contact circuit thereof, e.g., changeover switches 26, 27, and 28 are put in the position opposite to those shown in the drawing. Therefore, the (+) circuit for the speaker is turned OFF from the (+) output poles of both side stereo speakers and connected to the output (+) pole of the radio amplifier D. The (−) terminal side of the radio speaker E is turned OFF from the right side speaker C and the right side output (+) poles, and connected to the output (−) pole of the radio amplifier D, i.e., it is grounded, whereby three sets of speakers are operated simultaneously by the monaural amplifier D of the radio. At this time, control over sound volume in the left and right side rear speakers and the front speaker for the radio is made possible by the rotary switches 30, 31, and 32.

In FIG. 8 electric bulb 45 is lit as a pilot lamp upon change of contact position of the changeover switch 29 to the power source side of the radio, which informs the user of the completion of said change to radio side. Also, in FIG. 9, the illuminating diodes 47 and 49 act as pilot lamps and inform the user of the change. As one of the diodes is provided for the stereo side, the change is better ascertained.

According to this invention, changeover between the stereophone and the radio can easily be performed by a single operation of the changeover switch to the (+) power terminal source of the battery B, and the stereophone can reproduce full sound with the front radio speaker functioning as a 3-channel matrix in addition to 2-speaker·2-channel on the rear side, and, further, as sound through the monaural radio can be reproduced by three sets of speakers provided on the front and rear sides, this invention exhibits an excellent sound-intensifying effect specifically in the small space of a car. In addition, as the radio speaker is utilized as the front stereo speaker, the arrangement described herein is not expensive to make and it is easy to locate the position where the changeover switch for the (+) power source of the battery is actuated, whether on the stereo side or on the radio side, by means of the pilot lamp and minimizes errors in operation and provides convenience for use as well as good appearance.

The characteristic of this embodiment resides in the provision of a device for additionally utilizing speakers for the car stereo in which a control over increase or decrease of sound volume in the front speaker can be performed without limitation.

Figure 10:
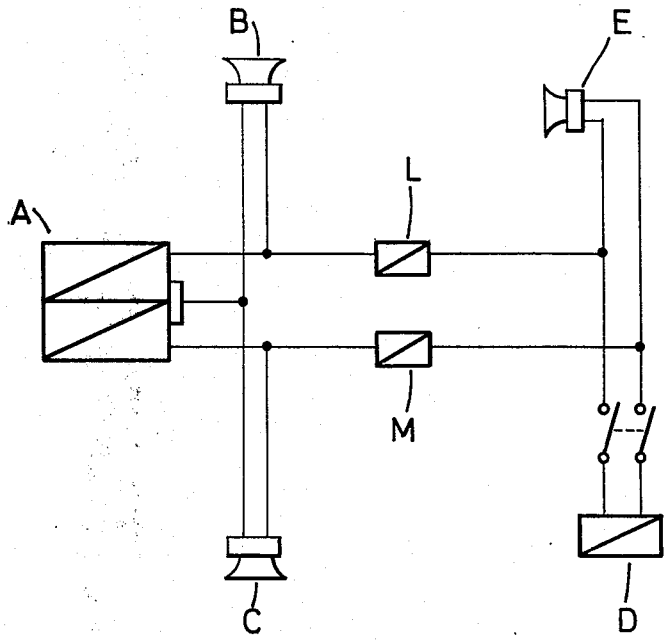
FIG. 10 is a diagram of circuit showing the main portion of the 9th embodiment of this invention.

FIG. 10 is a diagram of circuit composition showing the principle of this embodiment wherein the amplifiers L and M are provided in both side output (+) circuits of the car stereo amplifier A, the output sides of said amplifier being connected to both terminals of the radio speaker E.

Figure 11:
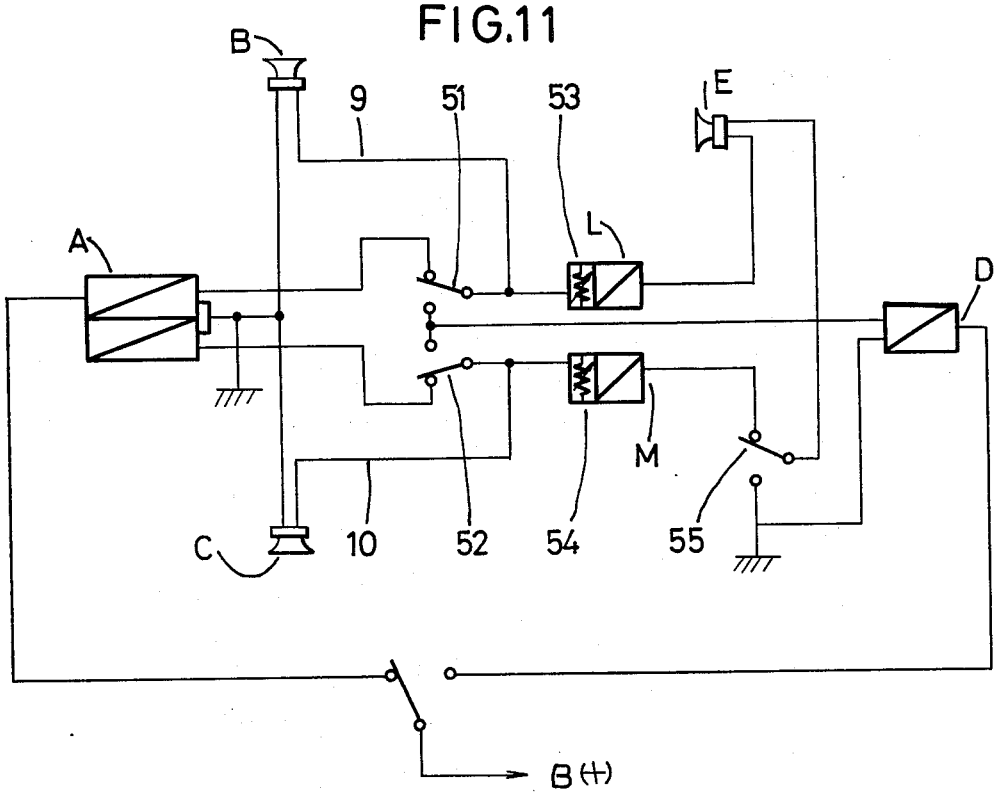
FIG. 11 is a diagram of circuit showing the 10th embodiment of this invention.

FIG. 11 is a diagram of circuit composition showing the 10th embodiment wherein the changeover switches 51 and 52 are adapted to switch the (+) terminal cords 9 and 10 to both side output (+) poles of the stereo amplifier A or to the output (+) pole of the radio amplifier D. The amplifiers L and M provided with output-variable circuits 53 and 54 are connected to the (+) terminal cords 9 and 10 of both side speakers, and the output sides thereof are connected to both terminals of the radio speaker E. The changeover switch 55 is provided between the (−) terminal side of the radio speaker E and the amplifier M, which makes it possible to switch the (−) terminal cords of the radio speaker E from the output side of the amplifier M to the (−) output side of the radio amplifier. The changeover switches 51, 52, and 55 are adapted to operate in association with each other.

The output-variable circuits 53 and 54 in the amplifiers L and M are adapted to be capable of performing simultaneous control over output of both amplifiers L and M.

The 9th and 10th embodiments operate as follows:

Referring to the diagrams, the changeover switches 51, 52, and 55 are put in such position as shown, i.e., a position for reproduction of sound through the stereo, and (+) output on both sides of the car stereo amplifier A is transmitted to both side speaker (+) terminal cords 9 and 10 through the changeover switches 51 and 52, operating both side speakers B and C, and at the same time, being amplified by the amplifiers L and M; and output of L is directly transmitted to both terminals of the radio speaker E, while that of M through the changeover switch 55, to operate the radio speaker. When the changeover switches 51, 52, and 55 which operate in association with each other are turned to the position opposite to that shown in FIG. 11, i.e., a position for reproduction of sound through the radio, the (+) terminal cords 9 and 10 of both side stereo speakers are switches from the (+) output side of the stereo amplifier A to the (+) output side of the radio amplifier D, whereby both side stereo speakers B and C are operated by output of the radio D. Output of the amplifier L is applied to the (+) terminal of the radio speaker E, and the (−) terminal side are switched to the (−) output side of the radio amplifier D by the changeover switch 55. Therefore, three sets of speakers, i.e., both side ones B and C for the car stereo and the one E for the car radio, are operated simultaneously by the radio amplifier D, working as a monaural 3-speaker system.

Sound volume in the car radio speaker E provided in the front part of the car can easily be increased or decreased by the output-variable circuits 53 and 54 of the amplifiers L and M. And, as it becomes unnecessary to provide resistors in series in the speaker circuit, there is no possibility of effect the quality of the sound because of a drop in the damping factor.

What is claimed is:

1. Apparatus for selectively combining the speaker means of a car radio with the left and right speaker means of a car stereo amplifier, said apparatus comprising:

a changeover switch connected to a power source, to said car radio, and to said car stereo amplifier for selectively connecting in a first position said car stereo amplifier to said power source and in a second position said car radio to said power source;

a changeover relay having a coil portion connected for energization by said power source in said second position of said changeover switch, said relay having first, second and third double-throw switch portions, wherein the arms of said switches are mechanically interconnected for mutual actuation when said coil portion is energized;

a first output damping circuit including first and second ganged rotary switches each having wiper arms and a number of contacts, the wiper arms of said first and second rotary switches being connected to the arm of said second switch portion of said relay, the central contact of said first rotary switch being connected to an input of said left speaker means, the contacts to a first side of said central contact being interconnected by resistors and the contacts to the other side being connected together, the central contact of said second rotary switch being connected to an input of said car radio speaker means, the contacts to said first side of said central contact being connected together and the contacts to the other side of the central contact being interconnected by resistors;

a second output damping circuit including first and second ganged rotary switches each having wiper arms and a number of contacts, the wiper arms of said first and second rotary switches being connected to the arm of said third switch portion of said changeover relay, the central contact of said first of said rotary switches being connected to one input of said right speaker means, the contacts on a first side of said central contact being interconnected by resistors and the contacts on the other side of said central contact being connected together, the central contact of said second rotary switch being connected to the normally closed contact of said first switch portion of said changeover relay, the contacts on said first side of said central contact being connected together and the contacts on the other side of said central contact being interconnected with resistors;

said car stereo amplifier having a left channel output connected to the normally closed contact of said second switch portion of said relay, a right channel output connected to the normally closed contact of said third switch portion of said relay, and a common output connected to said left and right speaker means;

said car radio amplifier having a first output lead connected to the normally open contact of said first switch portion of said relay and a second output lead connected to both normally open contacts of said second and third switch portions of said relay; and said car radio speaker means having an input connected to the arm of said first switch portion of said relay, whereby in said first position of said changeover switch said car stereo amplifier is energized and is connected to said left and right speaker means and to said car radio speaker means through said first and second damping circuits such that as said wiper arms are moved to said first side of said central contacts the resistors are placed in the circuits of said left and said right speakers and said car radio speaker is directly connected to said car stereo amplifier, and when said wiper arms are moved to the other side of said central contacts said resistors are placed in the circuit of said car radio speaker means, and whereby in said second position of said changeover switch said relay coil portion is energized and the arms of said first, second, and third switch portions are actuated and said car radio is energized and is connected to said left and right speaker means and to said car radio speaker through said first and second damping circuits.

* * * * *